US007052121B2

(12) United States Patent
Yamada

(10) Patent No.: US 7,052,121 B2
(45) Date of Patent: May 30, 2006

(54) INK CARTRIDGE AND INK JET PRINTER

(75) Inventor: Koji Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 10/731,426

(22) Filed: Dec. 10, 2003

(65) Prior Publication Data

US 2004/0165044 A1 Aug. 26, 2004

(30) Foreign Application Priority Data

Dec. 10, 2002 (JP) ..... P2002-358386

(51) Int. Cl.
*B41J 2/175* (2006.01)

(52) U.S. Cl. ..... 347/86

(58) Field of Classification Search ..... 347/29, 347/30, 31, 36, 85, 86, 87
See application file for complete search history.

(56) References Cited

U.S. PATENT DOCUMENTS

| | | | | |
|---|---|---|---|---|
| 4,383,263 | A * | 5/1983 | Ozawa et al. | 347/30 |
| 4,965,596 | A * | 10/1990 | Nagoshi et al. | 347/36 |
| 5,039,999 | A | 8/1991 | Winslow et al. | |
| 5,646,666 | A * | 7/1997 | Cowger et al. | 347/87 |
| 5,764,259 | A * | 6/1998 | Nakajima | 347/86 |
| 5,953,030 | A | 9/1999 | Ishinaga et al. | |
| 5,956,061 | A * | 9/1999 | Ahn | 347/87 |
| 6,070,976 | A | 6/2000 | Takagi et al. | |
| 6,213,600 | B1 | 4/2001 | Kobayashi et al. | |
| 6,302,532 | B1 | 10/2001 | Ishinaga et al. | |
| 6,428,152 | B1 * | 8/2002 | Hollands | 347/85 |
| 6,478,416 | B1 | 11/2002 | Ishinaga et al. | |
| 2001/0040613 | A1 | 11/2001 | Nakazawa et al. | |

FOREIGN PATENT DOCUMENTS

| | | |
|---|---|---|
| EP | 0 463 849 | 1/1992 |
| EP | 0 791 464 | 8/1997 |
| JP | 4-232755 | 8/1992 |
| JP | 8-72258 | 3/1996 |
| JP | 8-323989 | 12/1996 |
| JP | 10-95128 | 4/1998 |
| JP | 2000-218816 | 8/2000 |
| JP | 2001-260390 | 9/2001 |
| JP | 2001-270127 | 10/2001 |
| JP | 2001-353882 | 12/2001 |

* cited by examiner

OTHER PUBLICATIONS

US 5,874,977, 02/1999, Ishinaga et al. (withdrawn)

*Primary Examiner*—Anh T. N. Vo
(74) *Attorney, Agent, or Firm*—Nixon & Vanderhye P.C.

(57) ABSTRACT

A casing body of an ink cartridge includes a first chamber allowing atmospheric air to enter therein, and a second chamber that stores ink. A lid within the second chamber moves vertically while partitioning the second chamber into a first space above the lid and a second space below the lid for storing ink. A gap between an outer periphery of the lid and an inner periphery of the second chamber allows a meniscus of ink to form therebetween. A partition is provided at an upper end of the second chamber to partition the first and second chambers. The partition includes a through hole at a portion which is away from the inner periphery of the second chamber, to allow the atmospheric air to enter the second chamber. An elastic member in the second chamber urges the lid upwards to maintain the second space of the second chamber at a negative pressure.

14 Claims, 7 Drawing Sheets

INK CARTRIDGE AND INK JET PRINTER

BACKGROUND OF THE INVENTION

The present invention claims foreign priority under 35 USC 119 based on Japanese Patent Application No. 2002-358386, filed Dec. 10, 2002, the contents of which are incorporated herein by reference.

The present invention relates to an ink cartridge having a plurality of ink chambers, each ink chamber having a movable member that descends with ink consumption. The invention also relates to an ink jet printer incorporating such an ink cartridge as an ink supply source.

In the related art ink cartridge for an ink jet printer, a bag-type related art ink tank is constructed such that a flexible ink bag filled with ink is in a rigid plastic case. Alternatively, a foam-type ink tank is constructed such that ink-absorbent foam or felt is in a rigid plastic case.

However, related art ink tanks have various problems and disadvantages. For example, but not by way of limitation, the efficiency of drawing ink from the bag and the foam or felt is poor. Also, the filling efficiency of the ink is low. As a result, it is difficult to reduce the size of the ink tank. Further, the bag-type ink tank has a probability of ink leakage due to poor sealing of the ink bag.

Additionally, the ink bag can break, such that ink leaks out of the bag when the ink bag and the plastic case containing the ink bag rub during transport. Related art attempts to prevent the rubbing and the bag breakage have included increasing the rigidity and strength of the flexible material forming the ink bag. However, in this modified related art ink bag, a negative pressure for supplying ink increases, and various problems arise. For example, but not by way of limitation, the amount of consumed ink increases, and the amount of residual ink varies.

Also, in the related art foam-type ink tank, foreign materials may enter the ink supplied from the foam. The foreign materials enter the ink and flow into the print head, thereby causing clogging of the printer head.

FIG. 7 shows a related art ink cartridge 100. Four ink chambers 102(1) to 102(4) are disposed side by side, with their upper ends open within a case 101. An L-shaped waste ink chamber 110 extends from the upper parts of those ink chambers to the side parts thereof.

The ink chambers 102(1) to 102(4) respectively include lids 103(1) to 103(4), which are vertically movable along the inner peripheral surfaces 102*a* of those chambers. Ink outlets 104(1) to 104(4) are formed in the bottom surfaces of the four ink chambers 102(1) to 102(4). Ink reservoirs 105 are respectively formed by bottom surfaces 102*b* and the inner peripheral surfaces 102*a* of the ink chambers, and the movable lids 103(1) to 103(4).

The movable lids 103(1) to 103(4) are urged by spring members 106 in an upward direction. As a result, the ink reservoirs 105 experience negative pressure. The strength of an ink meniscus formed in a gap between each inner peripheral surface 102*a* and an associated one of those movable lids 103(1) to 103(4) is selected such that the ink meniscus is not broken by an ink suction force of the print head, which exerts pressure on the ink outlet.

The foregoing related art ink cartridge 100 may be used for a multi-color ink cartridge, in which different colors of ink are stored in the four ink chambers 102(1) to 102(4).

However, each of the movable lids 103(1) to 103(4) is held within an associated one of the ink chambers 102(1) to 102(4) by the ink meniscus formed in a gap between the inner peripheral surface 102*a* of the ink chamber and the outer peripheral surface of the movable lid to form the ink reservoir 105 in the lower side of the movable lid. Thus, the ink meniscus may break when impact is applied to the ink cartridge 100, so that ink leaks to the upper side of the movable lid (i.e., the side closer to the waste ink chamber 110).

When the ink leaks to the upper side of the movable lid, the leaked ink from the respective ink reservoirs 105 may mix with ink from other reservoirs. Then, the mixed ink may return to the respective ink reservoirs 105. In addition, since the waste ink chamber 110 is filled with an ink absorbing member of foam or felt, fine particles contained in the ink absorbing member may mix with the leaked ink and enter the ink reservoirs 105.

SUMMARY OF THE INVENTION

It is an object of the present invention to overcome at least the foregoing related art problems, as well as other problems well-known to those skilled in the art. However, the present invention is not required to be directed to solving any of the aforementioned related art problems.

It is therefore an object of the invention to provide an ink cartridge capable of preventing foreign materials from entering ink reservoirs, and avoiding mixture of ink leaked from the other ink reservoirs.

It is also an object of the invention to provide an ink jet printer incorporating such an ink cartridge as an ink supply source.

To achieve at least the above objects, according to an exemplary, non-limiting embodiment of the present invention, an ink cartridge is provided, comprising:

a casing body, including a first chamber, allowing atmospheric air to enter therein, and a second chamber storing ink therein;

a lid member, disposed within the second chamber movably in a vertical direction, while partitioning the second chamber into a first space above the lid member and a second space below the lid member for storing ink, the lid member configured such that a gap is formed between an outer periphery of the lid member and an inner periphery of the second chamber such that a meniscus of ink is formed therebetween;

a partition member, which partitions the first chamber from the second chamber, the partition member provided at an upper end of the second chamber, and having a through hole formed at a portion which is away from the inner periphery of the second chamber, the through hole allowing the atmospheric air to enter the second chamber; and an elastic member, disposed in the second chamber to urge the lid member upwards so as to maintain the second space of the second chamber at a negative pressure.

In such a configuration, since the first chamber communicating with the atmosphere is partitioned from the second chamber, ink leaked from the second space of the second chamber via the outer periphery of the lid member hardly flows to an exterior of the ink cartridge via the first chamber.

This configuration is applicable to a multi-color ink cartridge in which a plurality of second chambers for storing plural colors of ink are provided. In such a case, even if one color of ink is leaked to the first space of the second chamber, the ink will not mix with another color of ink. Accordingly, troubles due to ink mixture can be avoided when the leaked ink returns to the second space of the second chamber.

Preferably, the ink cartridge further comprises a projection formed around the through hole so as to project from the partition member toward the first chamber.

In such a configuration, ink leaked to the first chamber will not return to the second chamber. Accordingly, it is possible to avoid problems and/or disadvantages caused by mixture of foreign matters with the leaked ink.

Preferably, the ink cartridge further comprises an ink absorber, disposed in the first chamber so as to surround an end of the through hole facing the first chamber.

In such a configuration, since ink leaked to the first chamber is absorbed by the ink absorber, at least the related art problems caused by the mixture of foreign matter with the leaked ink can be avoided.

Here, it is preferable that the ink absorber is positioned away from the end of the through hole.

If the ink absorber is in contact with the through hole, ink leaked to the first space of the second chamber may be sucked by the ink absorber.

According to the above configuration of the present invention, only the ink leaked to the first chamber is absorbed by the ink absorber, so that less ink is wasted.

Preferably, the ink cartridge further comprises a projection provided on at least one of a surface of the partition member facing the first space of the second chamber and an upper face of the lid member.

In such a configuration, since the lid member and the partition member are brought into substantially line contact with each other, adhesion of these members due to face contact therebetween is avoided.

Here, it is preferable that the projection is formed around the through hole so as to project from the partition member toward the second chamber.

Preferably, a dimension of an inner periphery of the second chamber is gradually reduced toward a lower end of the second chamber.

When the lid member closes to the lower end of the second chamber due to ink consumption, the urging force of the elastic member increases so that the meniscus formed in the gap between the outer periphery of the lid member and the inner periphery of the second chamber tends to be broken. However, according to the above configuration, the gap is narrowed in accordance with the ink consumption, so that the strength of the meniscus increases. Therefore, even when the air bubbles do not enter the second space of the second chamber.

Preferably, the ink cartridge further comprises: an inlet, connected to the first chamber and configured to supply waste ink to the first chamber; an outlet, connected to the second chamber at a lower end of the second chamber, through which the ink is supplied to an exterior of the ink cartridge; and a vent port, formed at a top portion of the ink cartridge to allow the atmospheric air to enter the first chamber. The first chamber communicates with the atmosphere at a top portion of the ink cartridge.

Preferably, the first chamber is an L-shaped space formed above and lateral to the at least one second chamber, for collection and storage of waste ink.

Preferably, the at least one second chamber comprises first through fourth supply chambers filled with black ink, cyan ink, magenta ink, and yellow ink, respectively.

According to the invention, there is also provided an ink jet printer, comprising: a print head; and the above ink cartridge, which supplies the ink from the second chamber to the print head.

Since the above ink cartridge is capable of preventing ink mixture invasion of foreign matter or air bubbles, nozzle clogging of the print head is avoided. Therefore, excellent quality of printing operation is secured.

Preferably, the ink jet printer further comprises: a platen for feeding a recording sheet in a sheet feeding direction, wherein a nozzle of the print head faces the platen; a carriage that reciprocatively moves the print head in a primary scanning direction; a cartridge holder that receives the ink cartridge and supplies ink to the print head via a nozzle; and a drive controller that controls operations of the ink jet printer.

Here, it is preferable that the cartridge holder includes an ink supply needle for removing ink from the second chamber, and an ink recovery needle that supplies a waste ink to the first chamber.

It is further preferable that the ink recovery needle receives the waste ink via a waste ink collecting passage from a nozzle cap by a pumping device positioned between the nozzle cap and the ink recovery needle.

BRIEF DESCRIPTION OF THE DRAWINGS

The above objects and advantages of the present invention will become more apparent by describing in detail exemplary, non-limiting embodiments thereof, with reference to the accompanying drawings, wherein.

DETAILED DESCRIPTION OF THE INVENTION

Exemplary, non-limiting embodiments of the present invention will be described with reference to the accompanying drawings.

Figure 1:
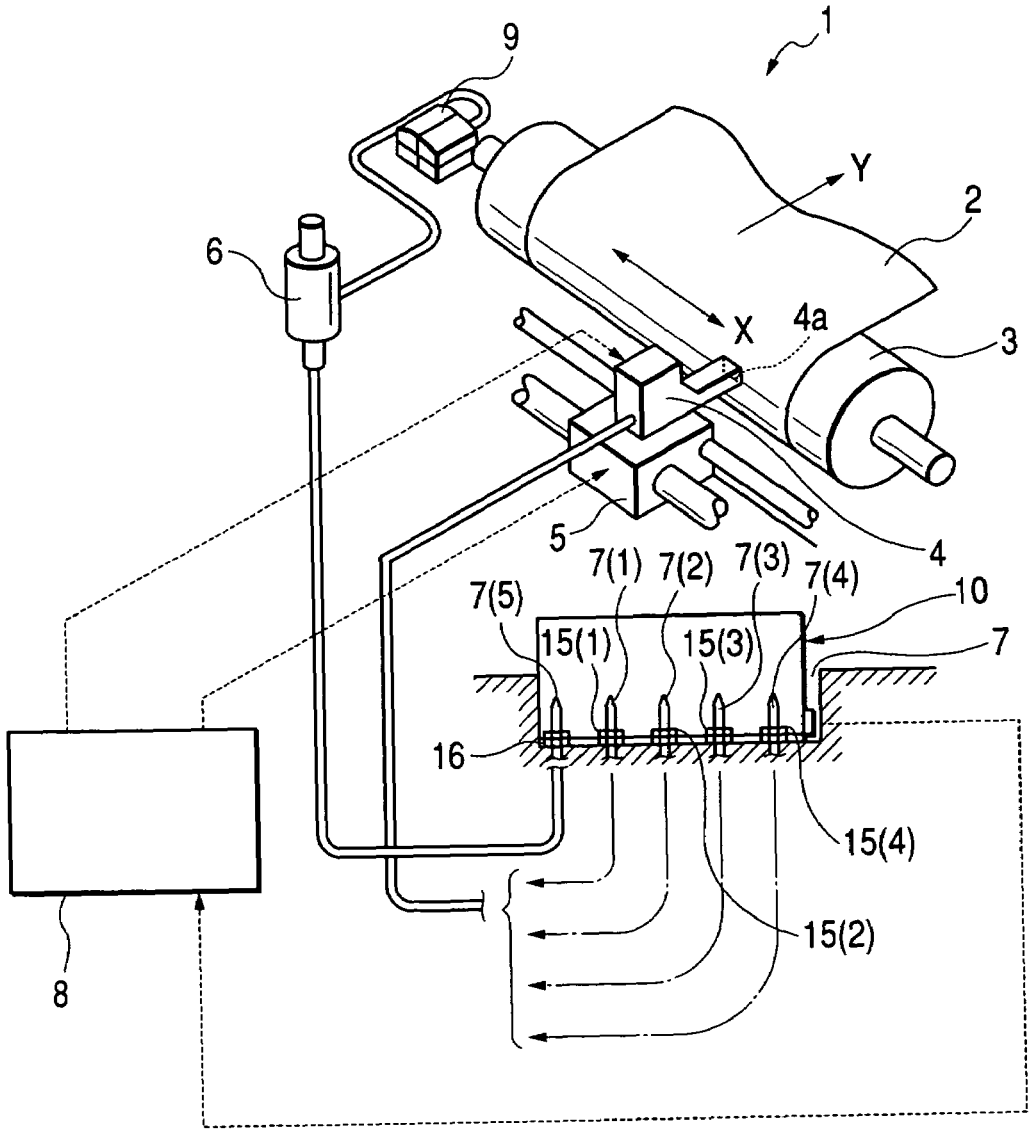
FIG. 1 illustrates a configuration of an ink jet printer according to an exemplary, non-limiting embodiment of the present invention.
Figure 2A:
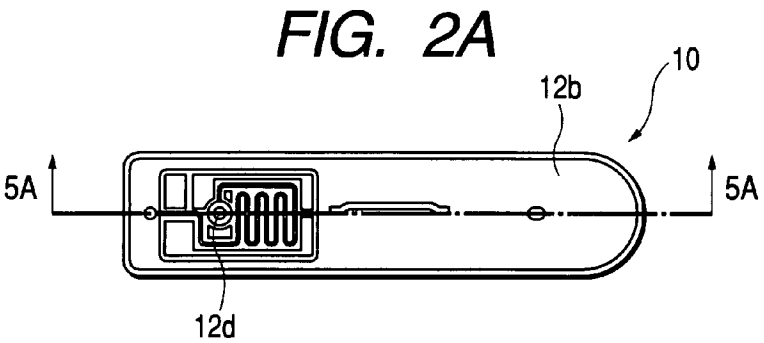
FIG. 2A is a top plan view of an ink cartridge according to an exemplary, non-limiting embodiment of the invention.
Figure 2B:
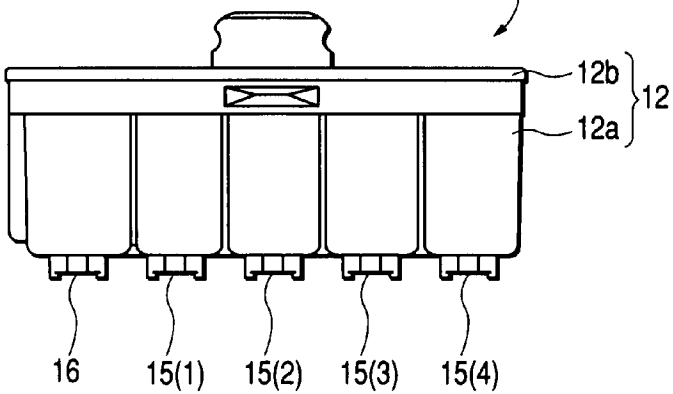
FIG. 2B is a side view of the ink cartridge according to an exemplary, non-limiting embodiment of the present invention.
Figure 2D:
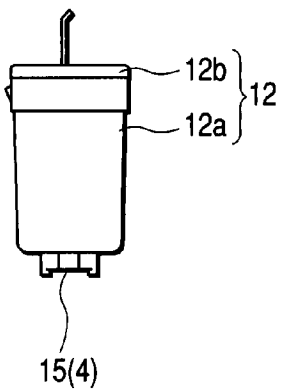
FIGS. 2C and 2D are side views of the ink cartridge according to an exemplary, non-limiting embodiment of the present invention.
Figure 2C:
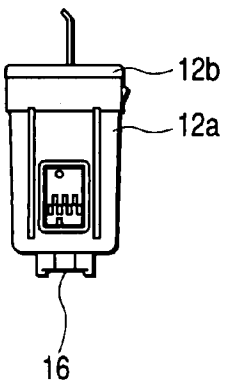
Figure 3:
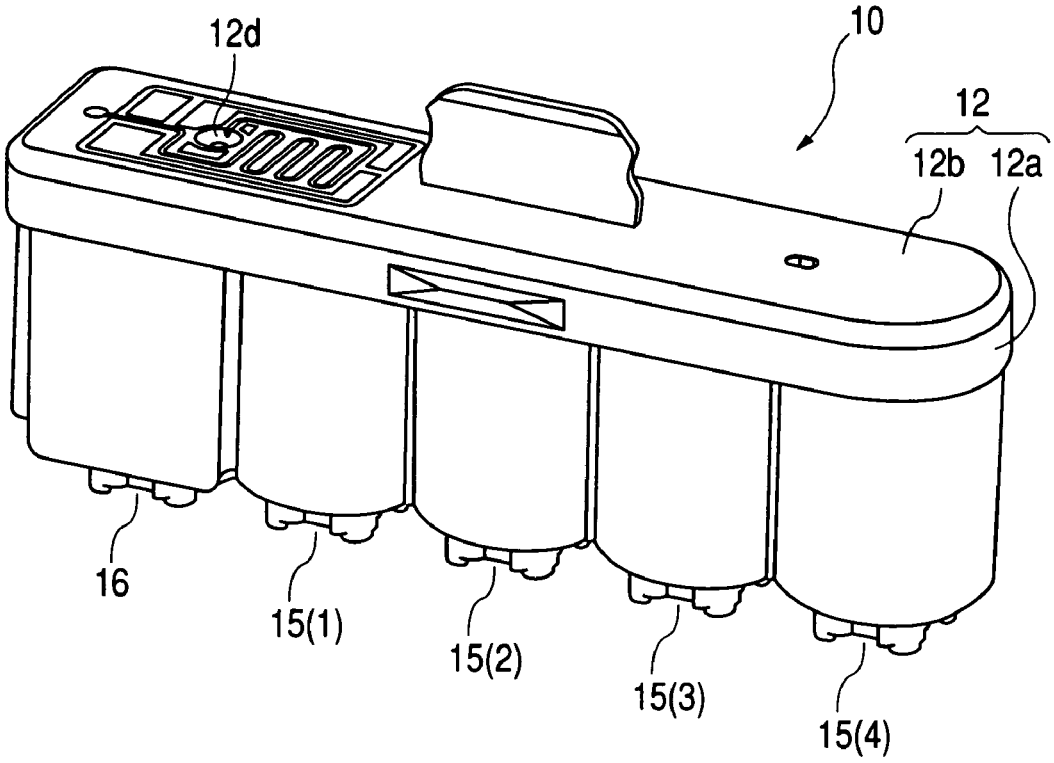
FIG. 3 is a perspective view of the ink cartridge according to an exemplary, non-limiting embodiment of the present invention.

FIG. 1 schematically shows an ink jet printer according to an exemplary, non-limiting embodiment of the present invention. The ink jet printer 1 includes: a platen 3 for feeding a recording sheet 2 in a sheet feeding direction Y; a print head 4 having a nozzle face 4*a* facing the platen 3; a carriage 5 for reciprocatively moving the print head 4 in a primary scanning direction X; a cartridge holder 7 for receiving a multi-color ink cartridge 10 which supplies different colors of ink to the ink nozzles of the print head 4; and a drive controller 8 for controlling the driving operations of related components.

The ink cartridge 10 includes, for example but not by way of limitation, four independent ink chambers which contain, for example, black ink, cyan ink, yellow ink and magenta ink, and an waste ink chamber 14 for collecting waste ink (described later in detail). The cartridge holder 7 is provided with ink supplying needles 7(1) to 7(4) for removing ink from the ink chambers, and an ink recovery needle 7(5) for supplying waste ink to the waste ink chamber 14. When the ink cartridge 10 is attached to the cartridge holder 7, ink supply passages are formed, which supply different colors of ink from the ink cartridge 10 to the print head 4.

The ink jet printer 1 includes a nozzle cap 9 located apart from the platen 3 in the printing direction X. The nozzle cap 9 is connected to the ink recovery needle 7(5), through a pump 6. When the ink cartridge 10 is attached to the cartridge holder 7, a waste ink collecting passage is formed ranging from the nozzle cap 9 to the waste ink chamber 14 in the ink cartridge 10, via the ink recovery needle 7(5). To collect waste ink from the print head 4, the nozzle face 4*a* of the print head 4 is covered with the nozzle cap 9. In this state, the ink pump 6 is driven.

As shown in FIGS. 2A through 5B, the ink cartridge 10 includes: a cartridge case 12 having a laterally elongated box shape; four ink chambers 13(1) to 13(4); and a waste ink chamber 14. The cartridge case 12 includes a case body 12*a* and a cover plate 12*b* that covers an opening of the top end of the case body 12*a*. The cover plate 12*b* is a thin plate, and its reverse side is a substantially flat surface. Ink outlets 15(1) to 15(4) for taking out ink from the ink chambers 13(1) to 13(4), and an ink inlet 16 for supplying waste ink into the waste ink chamber 14, are formed in a bottom plate 21 of the case body 12*a*.

Figure 4:
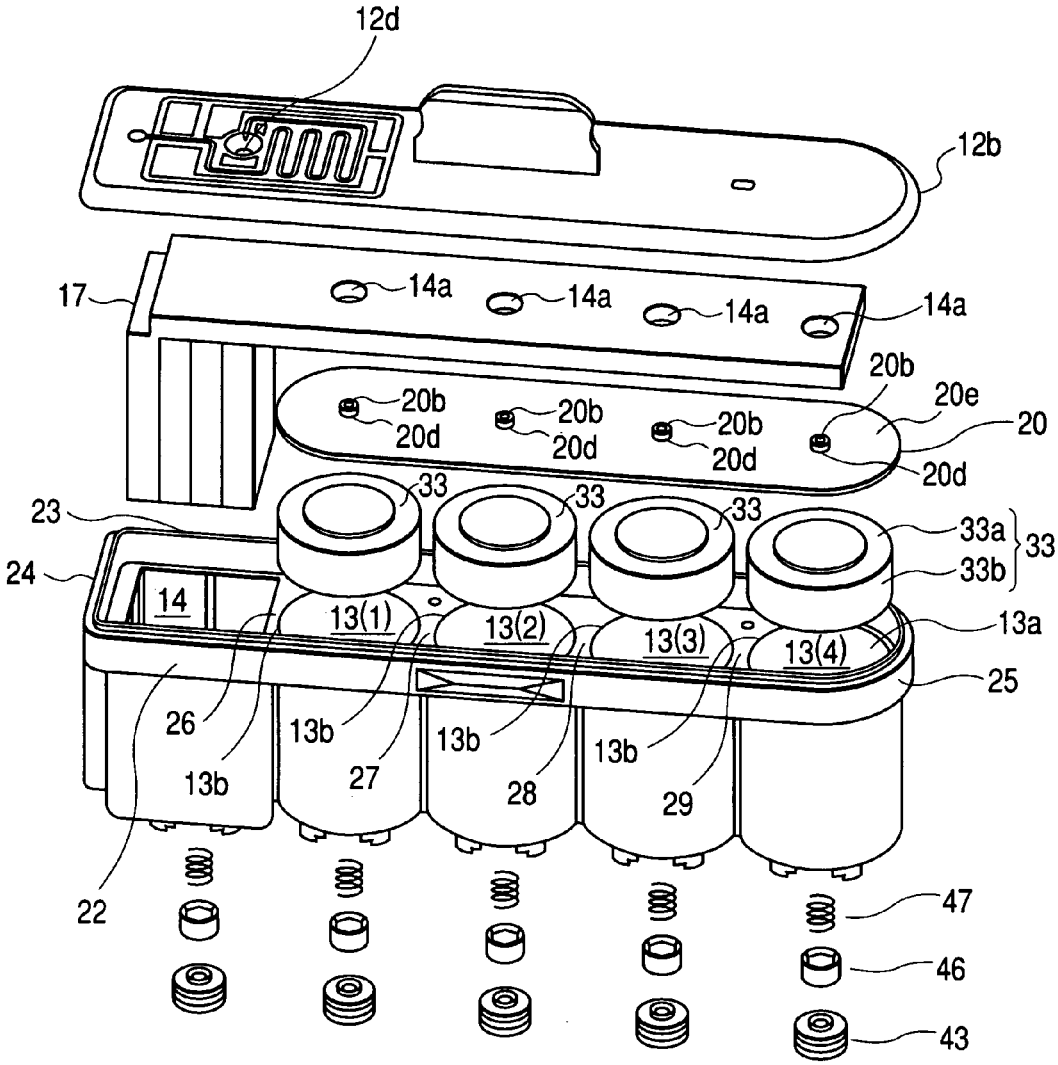
FIG. 4 is a perspective view of a disassembled state of the ink cartridge according to an exemplary, non-limiting embodiment of the present invention.
Figure 5A:
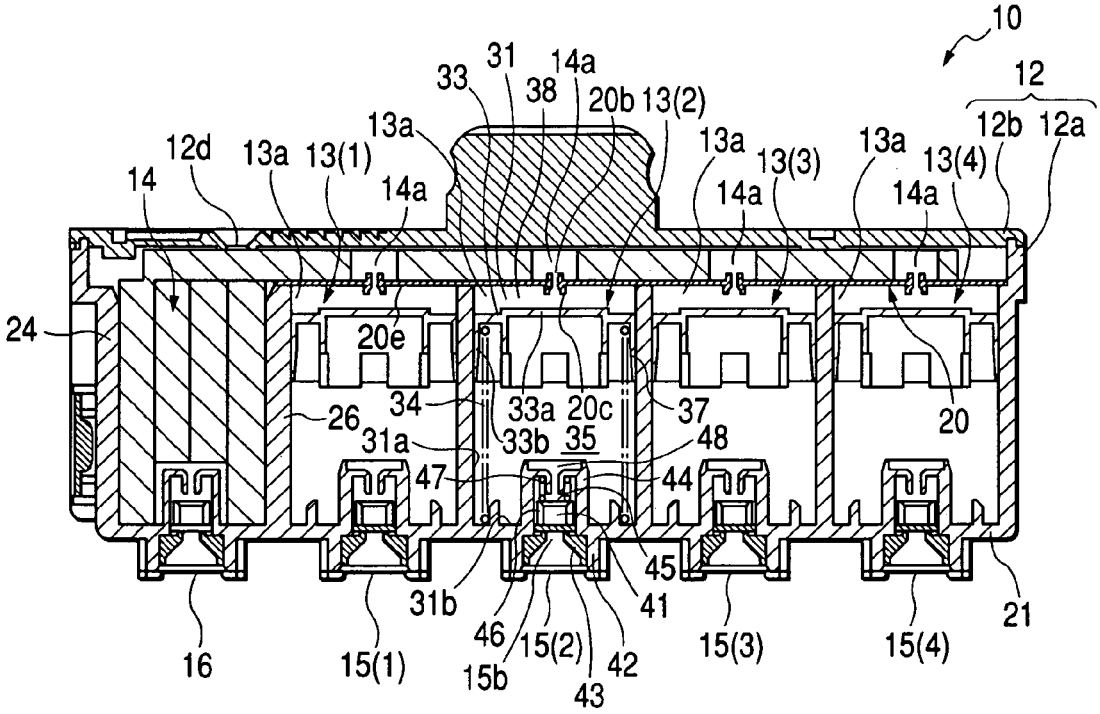
FIG. 5A is a section view of the ink cartridge, taken along the line 5A—5A in FIG. 2A, according to an exemplary, non-limiting embodiment of the present invention.

The respective portions of the ink cartridge 10 will be described in detail. As shown in FIGS. 4 and 5A, the case body 12*a* of the cartridge case 12 is formed with the bottom plate 21 having the ink outlets 15(1) to 15(4) and the ink inlet 16, opposed side walls 22 and 23 extending from the edges of the long sides of the bottom plate 21, and opposed end portions 24 and 25 extending from the edges of the short sides of the bottom plate 21. The end plate portion 25 is arcuate in shape, and smoothly continuous to the side walls 22, 23.

Four ink chambers 13(1) to 13(4), each circular in cross section, are formed within the case body 12*a* of the cartridge case 12. Those ink chambers are open at top ends, and partitioned by four partition walls 26 to 29, each of which connects to both of the side walls 22, 23. Top end openings 13*a* of the ink chambers 13(1) to 13(4) are sealingly closed with a partition plate 20 made of a plastic material, for example but not by way of limitation.

Figure 6A:
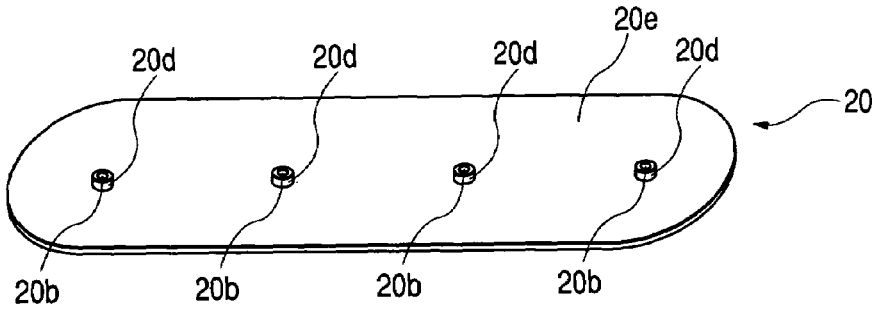
FIG. 6A is a perspective view of an upper side of a partition plate in the ink cartridge according to an exemplary, non-limiting embodiment of the present invention.
Figure 6B:
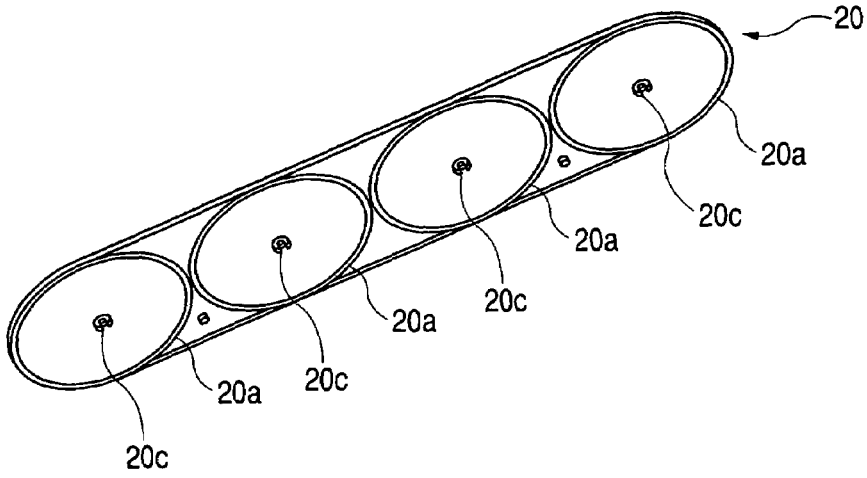
FIG. 6B is a perspective view of a lower side of a partition plate in the ink cartridge according to an exemplary, non-limiting embodiment of the present invention.
Figure 7:
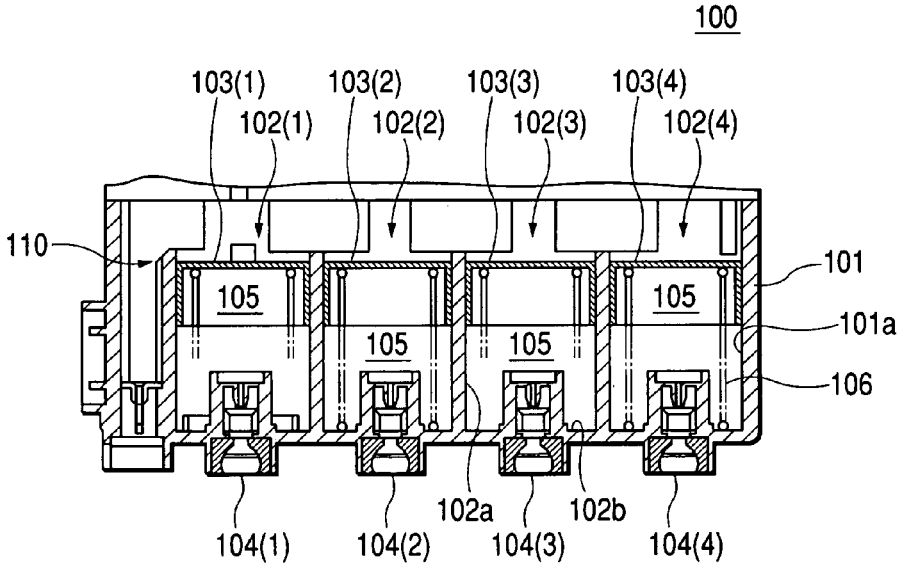
FIG. 7 is a section view of a related art ink cartridge.

FIGS. 6A and 6B are perspective views showing the partition plate 20 as viewed from top and bottom, respectively. Four annular projections 20*a* are provided on the lower surface of the partition plate 20, while corresponding in position to circular edges 13*b* (see FIG. 4) of the top end openings 13*a* of the ink chambers 13(1) to 13(4). The annular projections 20*a* are thermally fused onto the edges 13*b*, so that the partition plate 20 is joined to the edges 13*b*.

Tubular projections 20*c* are formed at the centers of the annular projections 20*a*, and tubular projections 20*d* are formed on an upper surface 20*e* of the partition plate 20, so as to correspond to the projections 20*c*. Air holes 20*b* extend from upper ends of the projections 20*d* to lower ends of the projections 20*c* while penetrating through the partition plate 20 in its thickness direction.

As shown in FIG. 5A, a space as an ink trap is elongated laterally between the partition plate 20 and the cover plate 12*b*, and a space for collecting the waste ink is elongated vertically between the side wall 24 and the partition wall 26, so that an L-shaped space is formed as the waste ink chamber 14. An ink absorbing member 17, such as foam or felt, is disposed in the waste ink chamber 14. An air hole 12*d* is located at a position of the cover plate 12*b* laterally with respect to the ink chamber 13(1).

Empty spaces 14*a*, each being circular in cross section, in which the ink absorbing member 17 is not present, correspond to the air holes 20*b* of the partition plate 20. By those empty spaces 14*a*, the air holes 20*b* are spaced from the ink absorbing member 17.

The ink chambers 13(1) to 13(4) are filled with black ink, cyan ink, magenta ink and yellow ink, respectively. Since the structure of those ink chambers 13(1) to 13(4) are the same, the structure of the ink chamber 13(2) will be representatively described, and in describing the remaining ink chambers 13(1), 13(3) and 13(4), like reference numerals are used for designating like elements.

The ink chamber 13(2) includes a cylindrical container 31 defined by the bottom plate 21, the side walls 22 and 23, and the partition walls 27 and 28. The upper end opening of the cylindrical container 31, viz., the top end openings 13*a* of the ink chamber 13(2), is sealed with the partition plate 20. A coiled spring 34 and a movable lid 33 are inserted into the cylindrical container 31 through the top end openings 13*a* before the partition plate 20 is thermally fused to the cylindrical container. The movable lid 33 is upwardly urged by the coiled spring 34. The ink outlet 15(2) is formed at the central part of the bottom surface 31*b* of the cylindrical container 31.

An ink reservoir 35 which reserves the ink is defined by the bottom surface 31*b*, the inner peripheral surface 31*a*, and the movable lid 33. An upper space 38 of the movable lid 33 communicates with the waste ink chamber 14, which is open to the air via the air hole 20*b* of the partition plate 20.

The movable lid 33 is vertically movable along the inner peripheral surface 31*a* of the cylindrical container 31. It includes a disc-shaped lid part 33*a* and a cylindrical part 33*b* which extends downwardly from the outer peripheral edge of the lid part 33*a*. By designing the cylindrical body part 33*b* to have a predetermined length, the movable lid 33 may be smoothly moved without rattling or dragging on the inner peripheral surface 31*a*. Filling the container 31 with ink, the ink advances into a gap 37 between the movable lid 33 and the inner peripheral surface 31*a* to form an ink meniscus therein. If the gap 37 is designed to have an appropriate dimension, a strength of the ink meniscus formed in the gap 37 is larger than an ink suction force acting on the ink outlet 15(2), so that the ink meniscus is not broken even at the time of ink sucking operation.

Specifically, the outer diameter of the cylindrical body part 33*b* of the movable lids 33 is smaller than the inner diameter of the inner peripheral surface 31*a* of the cylindrical container 31 by about 0.1 mm. When the movable lid 33 is inserted into the cylindrical container 31 in a coaxial fashion, an annular gap 37 of about 0.05 mm wide is formed between them. To prevent the movable lid 33 from dragging along the inner peripheral surface 31*a*, the length of the cylindrical body part 33*b* is about 8 mm.

Further, the ink reservoir 35 is always in a state that a predetermined negative pressure is applied by a lifting force of the movable lid 33 caused by the coiled spring 34. Accordingly, when the ink suction force does not act on the ink outlet 15(2), the ink does not leak out of the ink reservoir 35 via the ink outlet 15(2).

A lifting force of the movable lid 33 caused by the coiled spring 34 is smaller than a strength of the ink meniscus and the ink suction force exerted by an outlet port 15*b*. Therefore, the ink meniscus is not broken by the lifting force of the coiled spring 34, and air bubbles do not advance into the ink reservoir 35.

When the ink is sucked from the ink outlet 15(2), the movable lids 33 move toward the ink outlet 15(2) in accordance with an ink suction amount. For example, the lifting force by the coiled spring 34 is selected to fall within a range from about 5 gf to about 15 gf, in view of the strength of the meniscus in the gap 37.

Since the central part of the upper surface of each movable lid 33 is flat, when the movable lid 33 moves upward, the upper surface of the movable lid 33 is brought into a substantially line contact with the lower end of the projection 20*c* of the partition plate 20, to stop the upward movement of the movable lid 33 (see FIG. 5A).

Figure 5B:
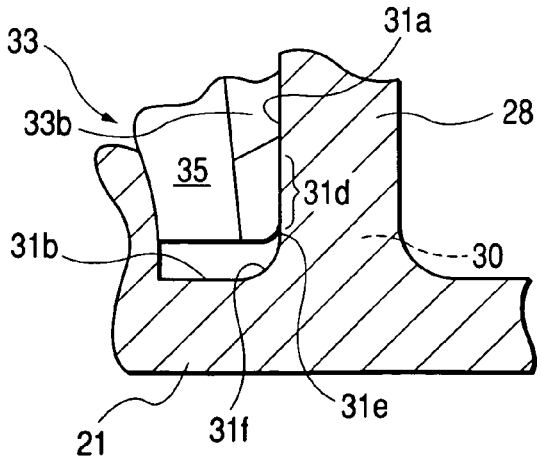
FIG. 5B is an enlarged view of a bottom portion of an ink chamber in the ink cartridge, according to an exemplary, non-limiting embodiment of the present invention.

As shown in FIG. 5B, at a part 31*d* of the inner peripheral surface 31*a* in the vicinity of the bottom surface 31*b*, the inner diameter of the container 31 is gradually reduced such that the inner diameter of the container 31 is made identical with the outer diameter of the movable lid 33 at a lower end portion 31*e* of the container 31. The lower end portion 31*e* continues to the bottom surface 31*b* via a curved corner 31*f*. In such a configuration, the gap between the lid 33 and the inner peripheral surface 31*a* is narrowed while the movable lid 33 closes to the bottom surface 31*b*, so that the strength of the meniscus formed in the gap increases. When the movable lid 33 reaches the lower end portion 31*e*, the movable lid 33 is secured by the inner peripheral surface 31*a*.

At a portion of the bottom wall 21 corresponding to the center of the bottom surface 31*b*, a circular opening 41 is formed and a tubular frame 42 is extended downward to surround the opening 41. An annular rubber packing 43 formed with a through hole is fitted into the cylindrical frame 42 so that the through hole serves as an ink outlet port 15*b*. A tubular frame 44 extends upward from the bottom surface 31*b* so as to surround the opening 41 to define a passage 45 between the ink reservoir 35 and the ink outlet port 15*b*. A valve 46 capable of sealing the ink outlet port 15*b* is disposed in the passage 45. The valve 46 is always pressed against the rubber packing 43 by a coiled spring 47 to seal the ink outlet port 15*b*.

A filter 48 for filtering out foreign materials is attached to an upper end of the tubular frame 44. Accordingly, the filter 48 catches foreign materials contained in the ink supplied from the ink reservoir 35 to the ink supplying needle 7(2), thereby preventing the foreign materials from entering the print head 4.

When the ink reservoirs 35 of the ink chambers 13(1) to 13(4) are filled with the respective colors of ink, the movable lids 33 are placed in the vicinity of the partition plate 20 as shown in FIG. 5A. Specifically, the movable lids 33 are positioned near the upper ends of the cylindrical containers 31.

Since ink meniscuses are each formed between the movable lid 33 and the inner peripheral surface 31*a* of each cylindrical container 31, the spaces 38 in the upper side of the movable lids 33, which communicate with the waste ink chamber 14, are partitioned from the ink reservoirs 35 by the movable lids 33. Further, since the movable lids 33 are each pushed upward by the coiled spring 34, the ink reservoirs 35 are each kept at a predetermined negative pressure.

When an ink suction force is exerted from the print head 4 of the ink jet printer 1 on each ink outlet port 15*b*, the movable lid 33 moves toward the ink outlet port 15*b* against the spring force of the coiled spring 34. As a result, a predetermined amount of ink is supplied to the print head 4, via the ink outlet port 15*b*.

The strength of the ink meniscus formed in the gap 37 between the movable lid 33 and the inner peripheral surface 31*a* of the cylindrical container 31 is larger than the ink suction force. Therefore, the ink meniscus is not broken by the ink suction force. As a result, air bubbles do not advance from the upper side of the movable lid 33 into the ink reservoir 35, via the gap 37. Further, ink does not leak from the ink reservoir 35 to the upper side of the movable lid 33, via the gap 37.

When the ink chambers 13(1) to 13(4) are each in an ink end state (i.e., there is substantially no more ink remaining in the chambers), the movable lids 33 are placed at the lower end portions 31*e* of the cylindrical containers 31, and capacities of the ink reservoirs 35 are reduced to the minimum. When the movable lid 33 descends, the coiled spring 34 is compressed and the force for lifting the movable lid 33 increases. Accordingly, the ink meniscus would be easy to break if the inner diameters remained the same.

However, since the inner diameters of the containers 31 are gradually reduced at tapered portions 31*d* so that the strength of the meniscuses increases, the invasion of air bubbles to the ink reservoirs 35 due to the meniscus breakage can be avoided, even in the ink end state.

When the ink cartridge 10 is accidentally dropped, or an impact force is applied to the ink cartridge 10, the movable lids 33 vibrate so that the ink meniscuses are broken. As a result, the ink leaks to the upper side of the movable lid 33. However, since the spaces 38 in the upper side of the movable lids 33 are separated from one another by the movable lid 33 and the partition plate 20 for each of the ink chambers 13(1) to 13(4), the ink leaked from the respective ink reservoirs 35 will not mix with ink from other reservoirs 35. In addition, since the air holes 20*b* are separated from the respective inner peripheral surfaces 31*a*, the ink leaked via the outer periphery of the movable lid 33 will not directly enter to the waste ink chamber 14 via the air holes 20*b*. To the contrary, the ink leaked to the spaces 38 returns to the respective ink reservoirs 35 along the inner peripheral surfaces 13*a*.

Even when ink leaks to the side of the waste ink chamber 14 via the air hole 20*b* formed at the upper end of the projection 20*d* and extended from the upper surface 20*e* of the partition plate 20, the leaked ink will not enter another ink chamber via another air hole 20*b*. Instead, the leaked ink is absorbed by the ink absorbing member 17 surrounding the projections 20*d*, and thus prevented from returning to the ink chambers 13(1) to 13(4) while being prevented from mixing with another color of ink. Since the leaked ink absorbed by the ink absorbing member 17 does not return to the ink chambers 13(1) to 13(4), the foreign matters derived from the ink absorbing material 17 will not mix with the ink leaked to the space 38, and returns to the ink reservoir 35.

Even when a substantial amount of ink leaks from the ink reservoir 35 and the space 38 fills with the leaked ink, since the air hole 20*b* is separated from the ink absorbing member 17, the leaked ink will not be sucked by the ink absorbing member 17. Since only ink leaked to the waste ink chamber 14 via the air hole 20*b* is absorbed by the ink absorbing member 17, less ink is rendered useless, and ink wastage is reduced.

Further, since the movable lids 33 are brought into the line contact with the lower ends of the projections 20*c*, the upper surfaces of the movable lids 33 are not brought into the face contact with the partition plate 20 and adhered thereon.

The present invention may also have various advantages, although it is not limited to these advantages, nor is it required to have these advantages. For example, but not by way of limitation, less ink is wasted, and inks of different colors are not mixed with one another. Further, foreign matter does not re-enter the reservoir, and the related art problems associated with dropping or impact of the cartridge are also substantially eliminated.

Although the present invention has been shown and described with reference to specific exemplary, non-limiting embodiments, various changes and modifications will be apparent to those skilled in the art from the teachings herein. Such changes and modifications as are obvious are deemed to come within the spirit, scope and contemplation of the invention as defined in the appended claims.

For example, but not by way of limitation, although the ink cartridge 10 of the above embodiment comprises four ink chambers, the number of the ink chambers may be less than or greater than four.

Further, the projections 20*d* may be omitted. Even in such a case, ink leaked through the air hole 20*b* is absorbed by the ink absorbing member 17 surrounding the air hole 20*b*.

In the above embodiment, a ringing phenomenon in which the partition plate 20 and the movable lid 35 are adhered is prevented by the tubular projection 20*c*. The tubular projection 20*c* may be provided on at least one of the partition plate 20 and the movable lid 35.

What is claimed is:

1. An ink cartridge, comprising:

a casing body including a first chamber allowing atmospheric air to enter therein, and a second chamber storing ink therein;

a lid member, disposed within the second chamber movably in a vertical direction, the lid member partitioning the second chamber into a first space above the lid member and a second space below the lid member for storing ink, wherein a gap is formed between an outer periphery of the lid member and an inner periphery of the second chamber such that a meniscus of ink is formed therebetween;

a partition member that partitions the first chamber from the second chamber, the partition member provided at an upper end of the second chamber, and having a through hole formed at a portion which is away from the inner periphery of the second chamber, the through hole allowing the atmospheric air to enter the second chamber; and an elastic member disposed in the second chamber, to urge the lid member upward, and maintain the second space of the second chamber at a negative pressure.

2. The ink cartridge as set forth in claim 1, further comprising a projection formed around the through hole so as to project from the partition member toward the first chamber.

3. The ink cartridge as set forth in claim 1, further comprising an ink absorber, disposed in the first chamber and surrounding an end of the through hole facing the first chamber.

4. The ink cartridge as set forth in claim 3, wherein the ink absorber is positioned away from the end of the through hole.

5. The ink cartridge as set forth in claim 1, further comprising a projection provided on at least one of a surface of the partition member facing the first space of the second chamber and an upper face of the lid member.

6. The ink cartridge as set forth in claim 5, wherein the projection is formed around the through hole so as to project from the partition member toward the second chamber.

7. The ink cartridge as set forth in claim 1, wherein a dimension of an inner periphery of the second chamber is gradually reduced toward a lower end of the second chamber.

8. The ink cartridge as set forth in claim 1, further comprising:

an inlet, connected to the first chamber, and configured to supply waste ink to the first chamber;

an outlet, connected to the second chamber at a lower end of the second chamber, through which the ink is supplied to an exterior of the ink cartridge; and a vent port, formed at a top portion of the ink cartridge to allow the atmospheric air to enter the first chamber.

9. The ink cartridge of claim 1, wherein the first chamber is an L-shaped space formed above and lateral to the second chamber, for collection and storage of waste ink.

10. The ink cartridge as of claim 1, wherein the second chamber comprises first through fourth supply chambers filled with black ink, cyan ink, magenta ink, and yellow ink, respectively.

11. An ink jet printer, comprising:

a print head; and an ink cartridge that supplies ink to the print head, comprising, a casing body including a first chamber allowing atmospheric air to enter therein, and a second chamber storing ink therein, a lid member, disposed within the second chamber movably in a vertical direction, the lid member partitioning the second chamber into a first space above the lid member and a second space below the lid member for storing ink, wherein a gap is formed between an outer periphery of the lid member and an inner periphery of the second chamber such that a meniscus of ink is formed therebetween, a partition member that partitions the first chamber from the second chamber, the partition member provided at an upper end of the second chamber, and having a through hole formed at a portion which is away from the inner periphery of the second chamber, the through hole allowing the atmospheric air to enter the second chamber, and an elastic member disposed in the second chamber, to urge the lid member upward, and maintain the second space of the second chamber at a negative pressure, wherein the ink cartridge supplies the ink from the second chamber to the print head.

12. The ink jet printer as set forth in claim 11, further comprising:

a platen for feeding a recording sheet in a sheet feeding direction, wherein a nozzle of the print head faces the platen;

a carriage that reciprocatively moves the print head in a primary scanning direction;

a cartridge holder that receives the ink cartridge and supplies ink to the print head via a nozzle; and a drive controller that controls operations of the ink jet printer.

13. The ink jet printer of claim 12, wherein the cartridge holder includes an ink supply needle for removing ink from the second chamber, and an ink recovery needle that supplies a waste ink to the first chamber.

14. The ink jet printer of claim 13, wherein the ink recovery needle receives the waste ink via a waste ink collecting passage from a nozzle cap by a pumping device positioned between the nozzle cap and the ink recovery needle.

* * * * *